United States Patent [19]

Hudon

[11] 4,098,507

[45] Jul. 4, 1978

[54] PORTABLE MINIATURE GOLF GAME

[76] Inventor: Jean-Paul Hudon, 130 des Tulipes St., Farnham, Canada

[21] Appl. No.: 766,178

[22] Filed: Feb. 7, 1977

[51] Int. Cl.[2] ..... A63B 69/36; A63F 7/06

[52] U.S. Cl. ..... 273/87 C; 273/176 B; 273/176 G; 273/34 B; 273/176 H

[58] Field of Search ..... 273/176 B, 176 F, 176 FA, 273/176 FB, 176 FC, 176 E, 178 R, 178 A, 178 B, 179 R, 179 A, 179 B, 179 C, 179 D, 179 E, 180, 34 B, 87 R, 87 A, 87 B, 87 C, 176 G

[56] References Cited

U.S. PATENT DOCUMENTS

| | | | |
|---|---|---|---|
| 1,922,333 | 8/1933 | Shawl | 273/176 E |
| 2,827,299 | 3/1958 | Dean | 273/176 F |
| 2,974,958 | 3/1961 | O'Herron | 273/176 B |
| 3,351,345 | 11/1967 | Robinette | 273/179 R X |
| 3,360,265 | 12/1967 | Yabroudy | 273/176 E X |
| 3,735,988 | 5/1973 | Palmer et al. | 273/34 B X |
| 3,862,760 | 1/1975 | Davis | 273/176 FA X |
| 3,897,067 | 7/1975 | Smith | 273/34 B X |

FOREIGN PATENT DOCUMENTS

| | | | |
|---|---|---|---|
| 29,957 | 7/1931 | Australia | 273/176 E |
| 318,213 | 2/1957 | Switzerland | 273/176 E |

*Primary Examiner*—George J. Marlo

[57] ABSTRACT

A portable, table type miniature golf game consisting of a game board made of easily and quickly assembled sections to take up minimum room when not in use. The game board has the configuration of a cross with the end of the main leg remote from the cross leg defining the starting zone of the play. Upstanding side walls are fixed to the edges of the panel and confine the golf ball to the playing surface. There are three cups made in the cross leg. One cup is visible from the starting zone, while the two remaining cups are not visible, the side walls forming an obstacle. The cups can be selectively plugged so that only one is used at any one time. Various hazards of different shapes can be removably positioned from the playing surface and their positions can be changed. Ball deflectors are also removably attached to the walls. A fortune wheel is associated with the game and determined by chance the number of points to be scored if the player sinks the ball in the cup in the indicated number of strokes.

10 Claims, 7 Drawing Figures

PORTABLE MINIATURE GOLF GAME

The present invention relates to a portable golf game simulating miniature golf games, including a panel with upstanding side walls, adapted to be placed on a table and to be played with a small diameter golf ball and a proportionately small putter.

The general object of the invention is to provide a golf game of the character described in which the shape of the playing surface, although non variable, is such that a great variety of "fairway" and "green" configurations can be obtained, while using a minimum of differently shaped obstacles, or hazards.

Another object of the invention is to provide a golf game of the character described in which the panel forming the playing surface is made of a series of sections easily and removably hooked together, so that the game can be stored in a minimum of space when not in use.

Another object of the invention is to provide a game of the character described in which the playing surface is provided with at least two spaced cups, or ball-receiving holes; either one of which can be plugged so that only one selected cup is used when playing a particular hole.

Another object of the invention is to provide a game of the character described, in which at least one cup is in the direct line of sight with the starting zone of play, while the other cups are located out of the direct line of sight and require that the golf ball make a broken trajectory from the starting zone to reach said cups.

Another object of the invention is to provide removable ball deflectors, some of which are attachable to the walls and at least one removably held by a cup.

Another object of the invention is to associate a fortune wheel with the playing board, which tells the player in how many strokes he must make a hole and how many points he will score if he makes the hole in the number of strokes indicated.

The foregoing and other objects of the invention will become more apparent during the following disclosure and by referring to the drawings, in which.

Figures 1, 2:
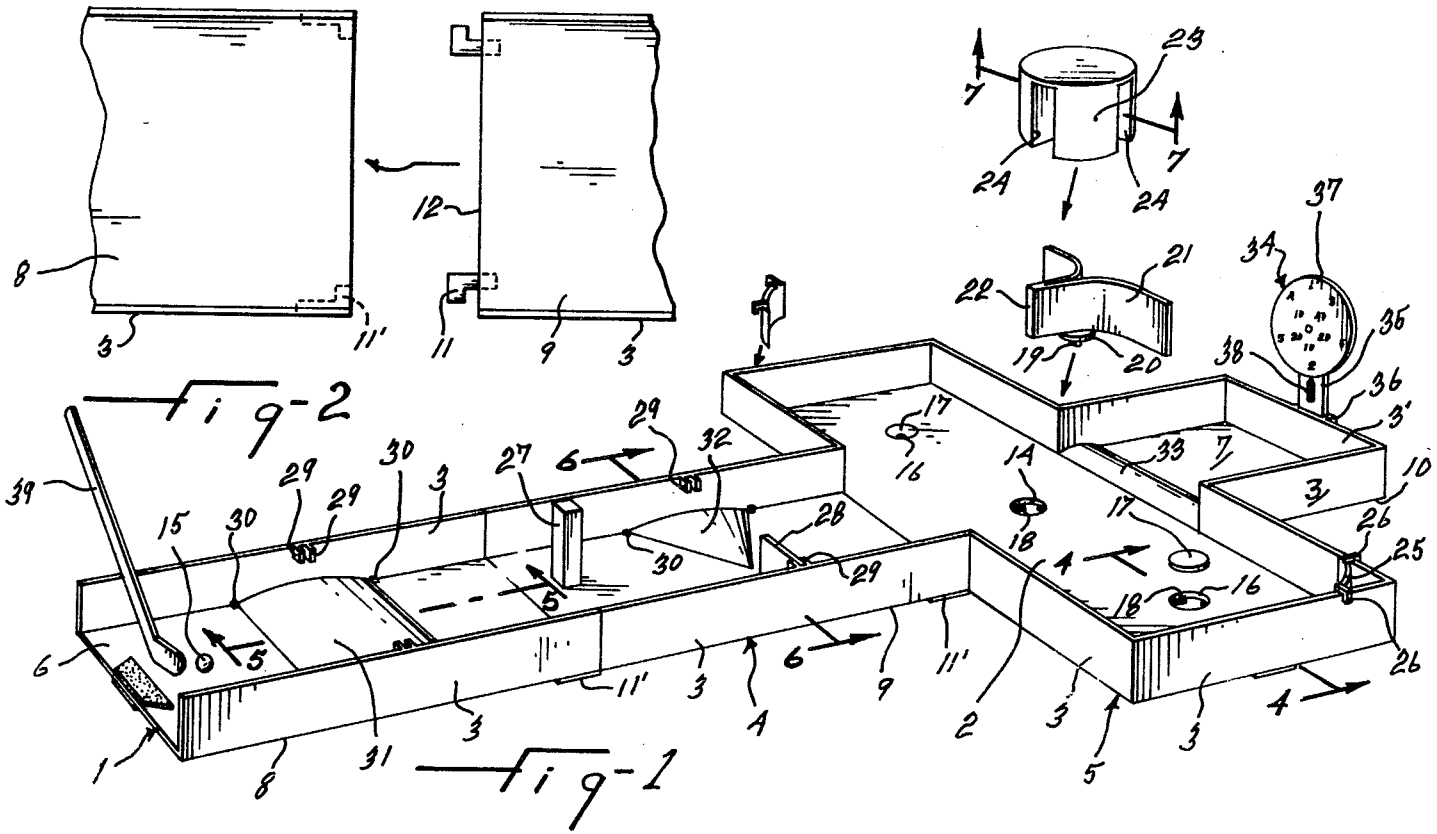
FIG. 1 is an exploded perspective view of the playing board, of two types of the ball deflectors and of one obstacle.
FIG. 2 is a partial top plan view of two of the playing board sections shown disassembled.
Figure 5:
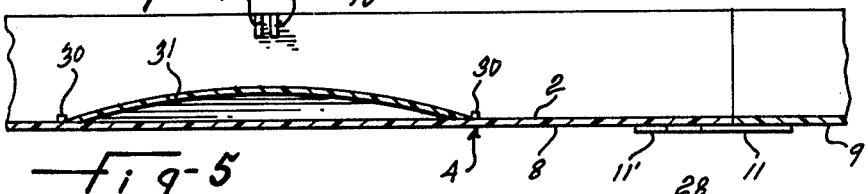
Figure 6:
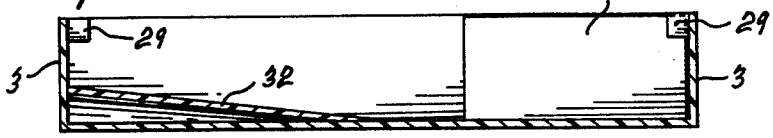

FIGS. 5 and 6 are partial sections taken along lines 5—5 and 6—6 of FIG. 1; and

Figure 7:
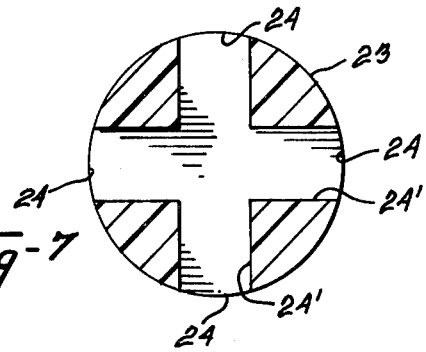

FIG. 7 is a plan section taken along line 7—7 of FIG. 1.

In the drawings, like reference characters indicate like elements throughout.

The miniature golf game of the present invention comprises a flat rigid panel 1 adapted to be placed on a table top and preferably made of rigid plastic material defining a smooth upper flat playing surface 2. Upstanding side walls 3, of uniform height, are secured to the edges of the flat panel 1, except at one end thereof. The panel 1 has the general shape of a cross when seen in top plan view defining a main leg 4 and a cross leg 5 substantially at right angles to the main leg and intercepting the latter in an area further away from the end 6 of the main leg than the end 7 of the same.

The end 6, which is devoid of a wall 3, constitutes a starting zone of play, or "tee" area. The cross leg 5, together with the end 7 of the main leg 4, constitutes the finishing zone of play. Each leg 4 and 5 is straight with parallel walls 3 and the cross legs extend equally on both sides of the main leg.

The panel 1 and walls 3 are constituted of several sections, which can be assembled and disassembled. More specifically, the cross leg 5 makes one section, while the main leg 4 consists of three sections: 8, 9, and 10. The sections 8 and 9 are removably attached together and the sections 9 and 10 are removably attached to the opposite sides of the cross leg section by means of flat interlocking L-shaped male and female hooking members 11 and 11', as shown in FIG. 2, which are secured to the bottom face of the panel sections.

Each male hooking member 11 protrudes from the corresponding end edge 12 of the panel section, with its transverse leg engageable behind the transverse leg of the female hooking member 11' attached to the adjacent end of the other section flush with said end. The section provided with the female hooking members is simply deposited on the male hooking members of the already laid section with the end edges of the two sections in abutting relationship to cause interengagement of the hooking members.

Figure 3:
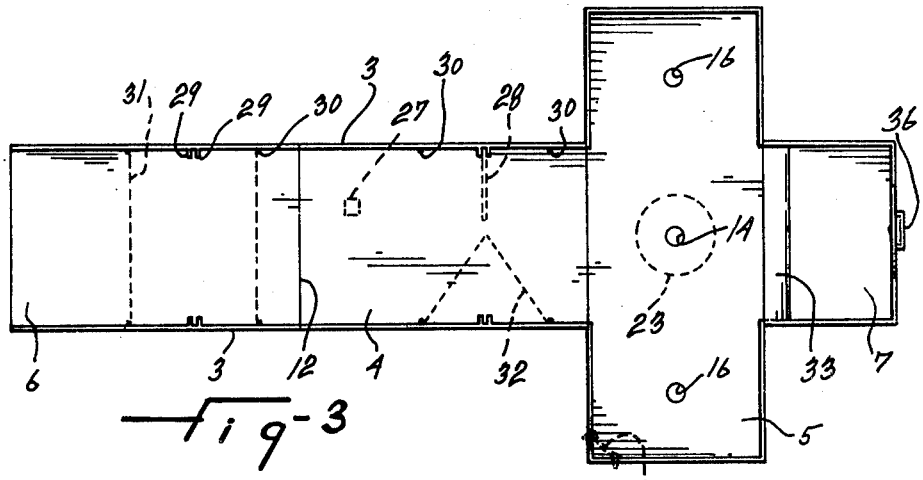
FIG. 3 is a top plan view of the playing board in assembled condition.
Figure 4:
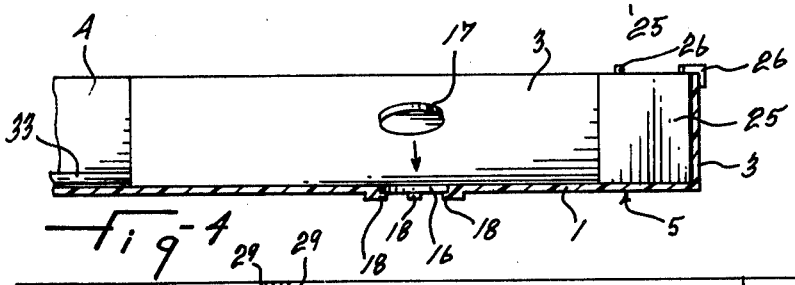
FIG. 4 is a partial section taken along line 4—4 of FIG. 1.

In accordance with the invention, the cross leg 5 is provided with one central cup 14 and at least one side cup 16 and, preferably, two cups 16, as shown in FIGS. 1 and 3. The cups are simply round holes, of equal diameter, made in the panel of a size sufficient to receive and catch a golf ball 15. Central cup 14 is located at the intersection of the center lines of the main leg and of the cross leg and is therefore in the direct line of sight from the end 6 of the main leg consisting of the starting zone of play. The two side cups 16 are located along the center line of the cross leg on each side of the central cup 14 in areas out of the line of sight from the starting zone of play. In other words, the side walls 3 form an obstacle to any straight path starting from, and established between, the starting zone and any of the side cups 16. Thus, the ball 15 cannot reach any of the side cups 16 in a straight line from the starting zone.

Means are provided to plug anyone of the cups 14 and 16. These means simply consist in two similar circular discs 17 of a diameter to fit and close two of the cups 14 and 16, while the remaining cup stays open. These discs 17 are retained in a position flush with the top surface of the panel by means of lugs 18 fixed to the underface of the panel and slightly protruding from the edge of the holes making the cups 14 and 16. These lugs 18 are spaced apart around the hole, so as to form intervening recesses adapted to receive with a sliding fit one or more spaced lugs 19 protruding underneath a disc 20 secured underneath a double wall deflector 21 consisting of two curved L-shaped wall sections joined together at one end and having a generally T-shape configuration when seen in top plan view. Thus, when the disc 20 is positioned, for instance, in the central hole or cup 14 in the same manner as disc 17, the double wall deflector is maintained in the proper orientation with the wall joint 22 facing the starting area by means of the lugs 19 inter-engaging with the lugs 18 of the hole 14. In the proper position, the double wall deflector will cause the golf ball 15 to be deflected towards the right-hand or left-hand side into the corresponding end zone of the cross leg 5. Obviously, double wall deflector 21 can be fitted into anyone of holes 16 with wall joint 22 facing towards an end of cross leg 5. Instead of the double wall deflector, one can use on the central hole 14, or on anyone of side holes 16, a cup obstacle, shown at 23, and consisting of a cylindrical block forming four ball entries 24 making a 90° angle between each other and being the inlets for two diametrical passages 24' intercepting at the center of the cylindrical block. The intercepting portion of the passages is positioned right over a cup 14 or 16. Thus, the golf ball is limited to enter the cup from only four directions.

Additional ball deflectors are provided with the game. Quarter round ball deflectors 25 have hooks 26 at right angles to each other, adapted to hook over the top edge of the side walls 3 in a corner, as shown in FIG. 1. These corners may be anyone of the reentrant corners at the two ends of the cross leg 5 and at the end 7 of the main leg 4.

Additional obstacles or hazards are provided with the game. Square posts 27, which are preferably hollow and properly weighted, can be positioned anywhere along the playing surface and mainly in the fairway part of the game, that is in the portion of the main leg proximate to the starting zone with respect to the cross leg.

Baffles 28, consisting of a rectangular flat plate of a length less than half the width of the main leg, are removably held in upright position by being inserted between two ears 29 secured to the top margin of walls 3; preferably the ears 29 are arranged in pairs which are transversely aligned of the main leg, so that baffles 28 can be arranged in pairs to further restrict the clear path for the ball. Also, the baffles can be arranged in staggered fashion.

The fairway section of the game board is also provided with small blocks 30 secured at the junction of the playing surface with the side walls 3, in pairs at a predetermined equal distance apart, so as to retain in position either a partially cylindrical ball rise 31 or a conically shaped ball rise 32, the base of which is equal to the base of the ball rise 31, so that ball rises 31 and 32 are interchangeable as to their position along the fairway.

The blocks 30, or lugs, are small enough so as to not impede the golf ball in its movement when no ball rises 31 or 32 are used. The end section 7 of the main leg is provided, at its junction with the cross leg, with preferably a permanently secured partly cylindrical ball rise 33. However, this ball rise could be removably secured in position by means of blocks 30, if so desired.

A fortune wheel 34 is preferably provided to be used for playing the game. This fortune wheel 34 consists of a support 35 removably mounted in upright position by being removably inserted into a sleeve 36 secured to the center part of the end wall 3'. The support 35 carries at its upper end a disc 37 rotatable about a horizontal central axis and bearing numbers arranged in radial pairs, the outer number indicating the number of strokes in which a particular hole configuration is to be played and the inner number of the radial pair indicating the number of points which will be granted to the player playing the hole within the number of strokes indicated.

The support 35 bears a reference arrow 38 adapted to point towards a pair of numbers, as determined by chance by rotation of the disc.

The game is played by hitting the ball 15 by means of a miniature putter 39 having the general shape of a hockey stick. As in the game of golf, it is intended to strike the ball with the putter from the tee-off or starting zone 6 and reaching the cup 14 or 16, which is uncovered, in a minimum of strokes or in the number of strokes, indicated by arrow 38 on disc 37.

Obviously, any number of the "fairway" and "green" configurations can be provided by changing the positions of the posts 27; the positions of the baffles 28; the positions of the ball rises 31, 32 of the ball deflectors and quarter rounds 21, 25, or by omitting any of these obstacles and hazards. Finally, by selecting one of the cups 14 and 16 while plugging the remaining cups, will result in a hole configuration analogous to straight "fairway" or to a right-hand or left-hand dog leg.

What I claim is:

1. A miniature golf game comprising a panel defining a flat playing surface having generally the shape of a cross, when seen in top plan view with a main leg and a cross leg intersecting said main leg intermediate the ends of the latter and nearer one end and substantially at right angles to said main leg, an upstanding side wall along the edges of said playing surface for confining a ball to said surface and said other end of said surface defining a starting zone of play, said cross leg defining a finishing zone of play and provided with at least two cups for receiving a ball, one of said cups located in the intersecting portion of said two legs, so that a straight path can be delineated from said starting zone to said one cup, and the other of said cups being located in a part of said cross leg, such that said wall constitutes an obstacle in any straight path from said starting zone to said second cup, means to removably plug one or the other of said cups, and pairs of blocks secured to the panel at the junction of the playing surface and the side walls and at a predetermined distance apart, and ball rises of different arcuate shape but each having a base width equal to said predetermined distance so as to make said arcuate ball rises interchangeable as to their position along the fairway.

2. A golf game as claimed in claim 1, wherein said cups are circular holes made in the panel and having equal diameters, and further including lugs secured to the underface of said panel and partially protruding within said holes, and said means to plug said cups including a flat disc of a diameter to slidably fit anyone of said holes and retained in said holes by means of said lugs with the top surface of the disc flush with said playing surface.

3. A miniature golf game as claimed in claim 2, further including a double wall ball deflector consisting of two right angularly curved wall sections joined together at one end and having a T-shape configuration when seen in top plan view, a disc secured to said two curved wall sections, of the same diameter as said first-named discs and adapted to be positioned within anyone of said holes, and a lug protruding from said last-named disc and fitting between the lugs of the holes to maintain said double wall deflector in a given orientation.

4. A miniature golf game as claimed in claim 1, wherein said cross leg protrudes equally from each side of said main leg and there are three cups aligned along the centerline of said cross leg, one of said cups being the central one lying also along the centerline of the main leg, while the remaining two cups are equally spaced from said center cup in the respective end zones of said cross leg.

5. A miniature golf game as claimed in claim 1, further including quarter round ball deflectors consisting of a curved wall section provided with hooking means to removably engage said side walls at anyone of the reentrant corners at the ends of said cross leg and at the remote end of said main leg.

6. A miniature golf game as claimed in claim 1, further including a ball obstacle consisting of a cylindrical block with two intersecting ball passages opening at the outer cylindrical surface of said cylindrical block and intersecting at the center of the block at right angles to each other, said block adapted to be positioned over one of said cups with the intersecting zone of the block passages immediately over said cup, so as to restrict to four the number of directions the ball can take to enter the cup.

7. A miniature golf game as claimed in claim 1, further including weighted square posts adapted to be located anywhere on the playing surface in upright position.

8. A miniature golf game as claimed in claim 1, further including pairs of ears projecting over said playing surface from the top edge of said side walls and upright baffles removably received and retained between said pairs of ears.

9. A miniature golf game as claimed in claim 1, wherein said panel and side wall form a plurality of detachable sections and means to removably attach said sections.

10. A miniature golf game as claimed in claim 1, further including a fortune wheel including an upright post removably secured to the panel and a disc rotatable on said post and bearing radial pairs of numbers, one number of each pair indicating a score and the other number of the pair indicating a number of strokes, said post carrying an arrow pointing towards said disc.

* * * * *